US005906064A

United States Patent [19]

Field

[11] Patent Number: 5,906,064

[45] Date of Patent: May 25, 1999

[54] UNIVERSAL MERCHANDISE SIGNAGE SYSTEM

[76] Inventor: Steven V. Field, 3031 Danalda Dr., Los Angeles, Calif. 90064

[21] Appl. No.: 08/946,610

[22] Filed: Oct. 7, 1997

Related U.S. Application Data

[63] Continuation of application No. 08/501,455, Jul. 12, 1995, abandoned.

[51] Int. Cl.[6] ..... G09F 15/00

[52] U.S. Cl. ..... 40/606; 40/607; 248/558

[58] Field of Search ..... 40/606, 607; 403/3, 403/299, 361; 248/558, 911, 912, 188

[56] References Cited

U.S. PATENT DOCUMENTS

| | | | |
|---|---|---|---|
| 3,721,463 | 3/1973 | Attwood et al. | 248/911 |
| 4,134,222 | 1/1979 | Orsos | 40/606 |
| 4,777,750 | 10/1988 | Garfinkle | 40/606 X |
| 5,400,992 | 3/1995 | Pohl | 40/606 X |

FOREIGN PATENT DOCUMENTS

| | | | |
|---|---|---|---|
| 12500 | of 1885 | United Kingdom | 403/299 |

OTHER PUBLICATIONS

BAHCO catalogue, adapters for impact sockets, 1986.

*Primary Examiner*—Cassandra H. Davis

*Attorney, Agent, or Firm*—Fulwider Patton Lee & Utecht, LLP

[57] ABSTRACT

A universal merchandise signage system for use with a plurality of different types of sign posts, each different type of sign post having a differently configured pin portion. The system includes a sign holder with an attachment member having different adapters configured to receive the different pin portions of the sign posts. The adapters are preferably inserts of various cross-sections, spaced apart within the attachment member. The attachment member preferably further includes a pair of upstanding ribs between which is held a pair of transparent panels. The signage system of the present invention provides that the sign holder is interchangeable among a plurality of sign posts commonly used by merchants, thereby reducing the inventory of sign holders that must be kept on hand.

2 Claims, 2 Drawing Sheets

UNIVERSAL MERCHANDISE SIGNAGE SYSTEM

This application is a continuation, of application Ser. No. 08/501,455, filed Jul. 12, 1995, now abandoned.

FIELD OF THE INVENTION

The present invention relates generally to signage for display along with merchandise, such as that commonly utilized in retail establishments. The present invention relates more particularly to a signage system utilizing modular attachment components for attaching the sign holder to a sign stand, thereby providing the highly desirable ability to rapidly mount, remove, or change the sign, and also facilitating flexibility in the number and type of sign posts utilized.

BACKGROUND OF THE INVENTION

Signage devices associated with the display of retail merchandise are well known. Such signage devices are commonly utilized to identify products, as well as to display prices and other information regarding the products being displayed. As those skilled in the art will appreciate, there is an abundance of diverse information such as size, color, type, as well as various promotional material commonly displayed via such signage devices. In addition, governmental regulations may require that particular information be provided to potential customers. For example, the materials from which articles are constructed most frequently be listed. Additionally, the fact that certain products are approved only for specified uses must occasionally be indicated.

Contemporary signage devices generally comprise a sign holder for holding a display card or the like, and a base having one or more posts attached to the sign holder, for mounting the display in a given orientation. The base of most signage devices are optionally fixedly attached to a rack or shelf, to resist inadvertent displacement of the sign.

Examples of such contemporary signage devices are provided in U.S. Pat. No. 2,050,136 issued to Tucker et al.; U.S. Pat. No. 2,112,583 issued to Tucker et al.; U.S. Pat. No. 3,956,837 issued to Itano; U.S. Pat. No. 4,144,664 issued to De Korte; U.S. Pat. No. 4,165,572 issued to Sussman; U.S. Pat. No. 4,594,882 issued to Field; and U.S. Pat. No. 4,790,093 issued to Ernest et al.

Due to the changing of inventory or the shifting of merchandise within a store, it is often desirable to change not only the display card, but also the type of sign holder. Certain sizes and orientations of signs are more compatible with certain classes of merchandise. Most sign holders are supported by a base having a single post. The post is typically of either of a circular pin, threaded pin, or square pin configuration, depending upon the sign manufacturer and/or the design application. As such, according to contemporary practice, it is necessary to keep an inventory of sign holders of various sizes, each being adaptable to one of the three common sign posts, i.e., circular pin, threaded pin, or square pin. As those skilled in the art will appreciate, it is both expensive and inconvenient to maintain such an inventory.

The Ernest et al. device holder (U.S. Pat. No. 4,790,093) comprises a two-piece plastic sign holder attached to a circular, planar base via an elongate extension member. The two-piece plastic sign holder is separable so as to facilitate the placement of a display card therebetween.

The De Korte device (U.S. Pat. No. 4,144,664) comprises a two part sign holder formed directly to a base. The base is configured for attachment to a planar surface and incorporates holes configured to receive mounting screws. Thus, the De Korte device may be mounted to a wall or other vertical surface, as desired.

Neither the Ernest et al., nor the De Korte, nor any of the other contemporary signage devices, provide the desired flexibility by facilitating attachment to either one or two separate sign posts, particularly sign posts of different types, i.e., circular pin, threaded pin, or square pin.

Recognizing this problem, one proposed solution of the prior art was to provide a sign holder that included a clamp configuration that could be attached to each of the three common sign posts. This proved to be an ineffective remedy, however, because the forces on the sign were borne in part by the clamp, not entirely by the sign posts as is the desired method of structural support.

SUMMARY OF THE INVENTION

The present invention specifically addresses and alleviates the above-mentioned deficiencies associated with the prior art. Generally, the present invention is a universal merchandise signage system including a sign holder having an attachment member interchangeable among the sign posts which are presently commonly in use. More particularly, the attachment member has adapters which are configured to receive the pin portion of the various sign posts. The universal signage system reduces the inventory of sign holders which must be kept on hand by merchants and thus substantially reduces inventory costs and storage requirements.

In a preferred embodiment of the present invention, the adapters of the attachment members are received within cavities and thus comprise inserts configured to receive circular, threaded, and rectangular cross-section pins found on sign posts commonly in use. The adapters are spaced apart in the attachment member, separated by a sufficient distance to avoid inserting the pin portion of the posts in the wrong adapter, i.e., the center adaptor when only the outboard two adapters are intended to be utilized. Such incorrect insertion of a sign post would result in the sign post being skewed or slanted from the base to the attachment member and may result in damage to the sign post, the attachment member, or the insert utilized for attaching the sign post to the attachment member.

Also, in a preferred embodiment of the present invention, the attachment member has a pair of upstanding ribs between which the sign holder, comprised of a pair of transparent panels, is releasably held. The upstanding ribs preferably have a lip formed along the upper inboard edges thereof, and the transparent panels preferably have a complimentary track formed along the lower outboard edges thereof. The track of each transparent panel is captured below the corresponding lip when the sign holder is installed in the attachment member.

As such, the present invention provides a sign holder that is interchangeable among the sign posts commonly in use and is consequently substantially more versatile in application than contemporary sign holders. Such sign holders of the present invention, having attachment members with specially configured adapters, may be readily removed, replaced, or changed with other sign holders, as desired. Further, the attachment members allow the sign holders, composed of pairs of transparent panels, to be easily and quickly swapped out, i.e., replaced with substitute sign holders.

A sign holder which has been previously configured for use with sign posts having square pin portions may therefore easily and conveniently be utilized with sign posts having round pin portions by merely removing the square pin portion adapters from the attachment member thereof and replacing the square pin portion adapters with round pin portion adapters. Thus, with minimal effort, a single sign holder of the present invention can easily be utilized among a plurality of different types of sign holders. Further, by positioning the adapters within the attachment member as desired, either one, two, or three sign posts may be utilized, as desired.

These, as well as other advantages of the present invention will become more apparent from the following descriptions and drawings. It is understood that changes in the specific structure shown and described may be made within the scope of the claims without departing from the spirit of the invention.

DETAILED DESCRIPTION OF THE PREFERRED EMBODIMENT

The detailed discussion set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
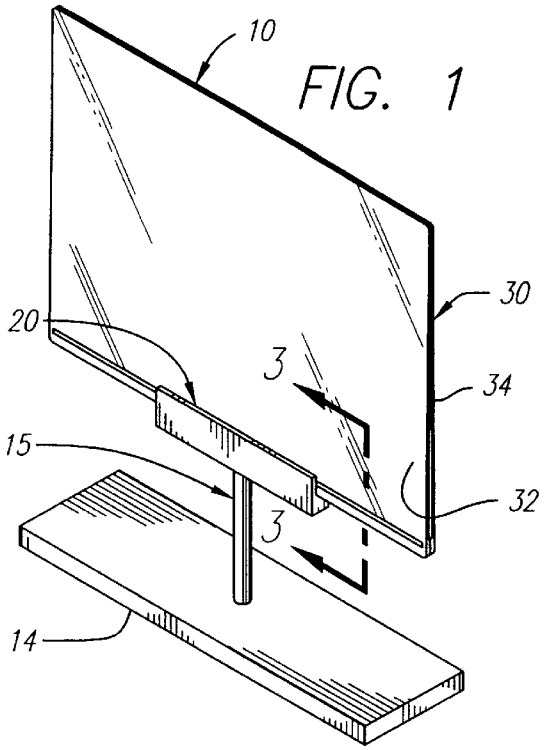
FIG. 1 is a perspective view illustrating the signage system of the present invention.
Figure 2:
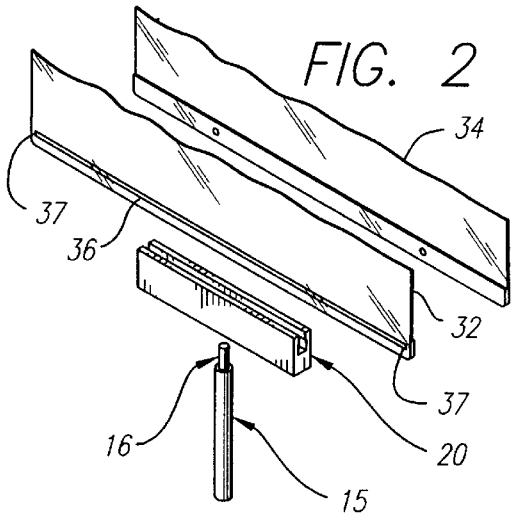
FIG. 2 is an exploded perspective view illustrating the principal components of the signage system.

The universal merchandise signage system 10 of the present invention is illustrated in FIG. 1–8 which depict a presently preferred embodiment of the invention. Referring now to FIGS. 1 and 2, the signage system 10 is configured for use with one or more posts 15, each post 15 having a pin portion 16 thereof. Generally, the present invention is configured for use with either one or two posts. However, those skilled in the art will appreciate that any desired number of such posts may be so utilized. The sign posts 15 are generally composed of metal and typically anchored to a garment rack or a store shelf (not shown), or the sign posts 15 may alternatively be attached to a base 14 as shown in FIG. 1. As those skilled in the art will appreciate, various other different means for anchoring sign post 15 are likewise suitable, and the present invention contemplates use with any such attachment or anchoring means.

Attachment Member

Figure 4:
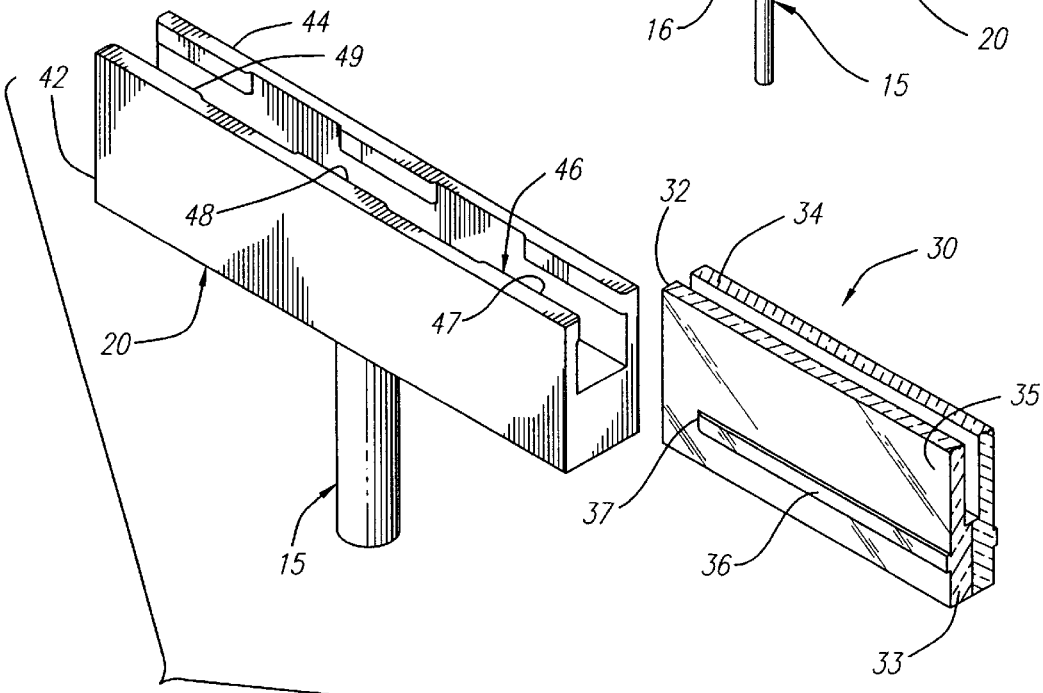
FIG. 4 is a disassembled perspective view of the signage system showing the transparent sign holder positioned for insertion into the attachment member.
Figure 5:
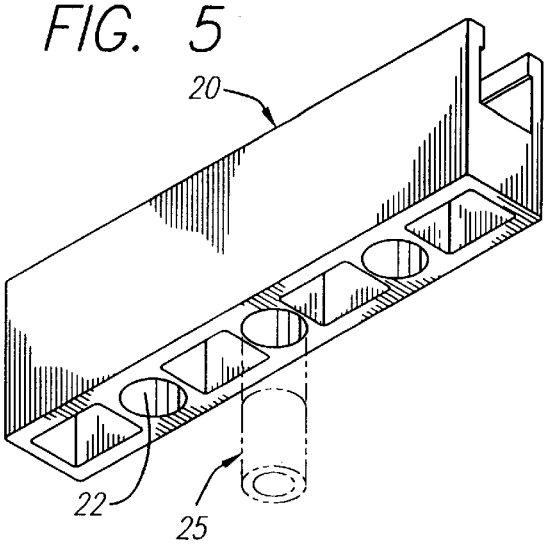
FIG. 5 is a perspective view of the attachment member showing the underside thereof.

Also referring to FIGS. 4 and 5, an attachment member 20 of the preferred embodiment of the signage system 10 is described. The attachment member 20 is preferably fabricated of molded plastic and has three cavities 22 (FIG. 5) formed therein. Those skilled in the art will appreciate that various other materials, e.g., metal, wood, etc., are likewise suitable. Disposed in each of the cavities 22 is a metallic insert 25. Each metallic insert 25 is configured to receive one particular type, i.e., round, threaded, or square, of pin portion 16 of the various sign posts 15.

Insert

Figure 6:
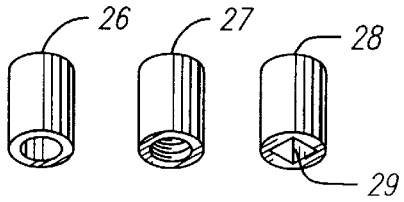
FIG. 6 is a perspective view of the inserts which are configured to be disposed within the attachment member.
Figure 7:
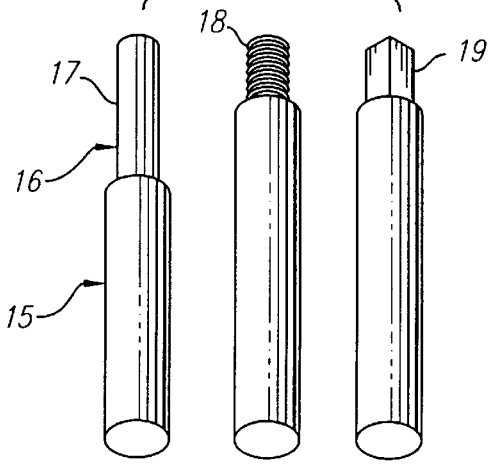
FIG. 7 is a perspective view of the pin portions of the sign posts.

Referring now to FIGS. 6 and 7, insert 26 is configured to receive a circular cross-section pin 17; insert 27 is configured to receive a threaded pin 18; and insert 28 is configured to receive a square cross-section pin 19. In addition, the entry end 29 of the square cross-section insert 28 may optionally be slightly enlarged or tapered to facilitate entry of the complementary square cross-section pin 19 thereto. The entry end of the circular insert 26 and the entry end of the threaded insert 27 may similarly enlarged or tapered, as desired.

Sign Holder

Now referring to FIGS. 1–4, a sign holder 30 of the preferred embodiment of the signage system 10 of the present invention is described. The sign holder 30 preferably includes a pair of opposing transparent, preferably plexiglass, panels 32 and 34, panel 34 being the opposite hand of panel 32. Alternatively, a conventional metal frame sign holder (not shown) could be used.

Figure 3:
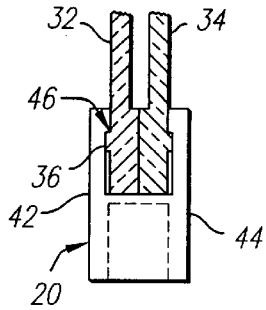
FIG. 3 is a cross-section side view of the attachment member and a sign holder.

Panel 32 includes a base portion 33, and an upper portion 35 of less thickness, leaving space to insert a sign (not shown) between the opposing panels 32 and 34. The lower portion 33 of the panel 32 has a raised track 36 (as best shown in FIGS. 2 and 3) that runs along a substantial portion of the length, preferably most, of the panel 32. The ends of the track 36 have a ramp 37 to transition to the planar surface of the panel 32, thereby facilitating easy insertion of the sign holder 30 into the attachment member 20.

Attachment Member Interface

Now referring to FIGS. 3 and 4, further details of the attachment member 20 and its interface to the sign holder 30 are described. The attachment member 20 preferably comprises a pair of upstanding ribs 42 and 44, upstanding rib 44 being positioned in opposition to upstanding rib 42. Upstanding rib 42 comprises a lip 46 formed along the inboard upper edge thereof. The lip 46 is preferably not continuous, and preferably comprises three inwardly extending tabs 47, 48, and 49 (as best shown in FIG. 4). As is clear from FIG. 3, the track 36 is configured to be disposed below and captured by the lip 46 when the sign holder 30 is installed in the attachment member 20.

Alternative Attachment Member

Figure 8:
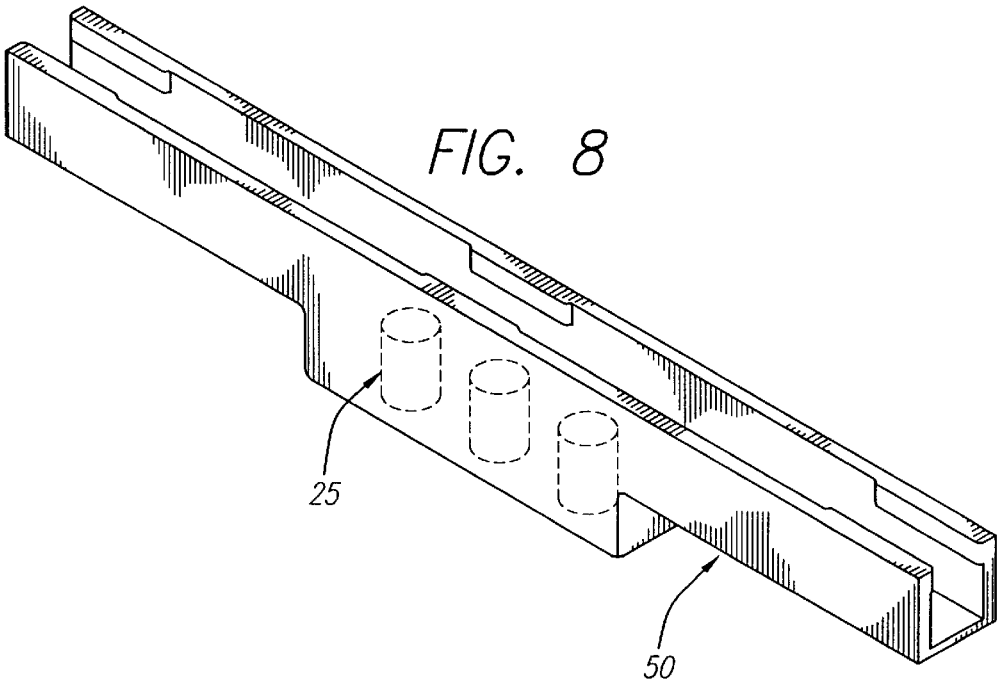
FIG. 8 is a perspective view of an alternative configuration of the attachment member wherein the attachment member is configured to span across substantially the entire length of the sign holder.

FIG. 8 illustrates an alternative configuration of the attachment member 50. This alternative embodiment of the attachment member 50 spans across substantially the entire length of sign holder 30. Attachment member 50 preferably becomes narrower at the outboard ends thereof, to facilitate efficient plastic management and to reduce costs.

Operation

Referring again to FIGS. 1–4, the operation of the sign holder 30 of the preferred embodiment of the signage system 10 of the present invention is described. The opposing plexiglass panels 32 and 34 are brought together to slide between the upstanding ribs 42 and 44 of the attachment member 20. The opposing panels 32 and 34 are easily inserted into either end of the attachment member 20, between the upstanding ribs 42 and 44. The raised track 36 together with the lip 46, namely tabs 47, 48, and 49, are operative to restrain the sign holder 30 within the attachment member 20.

Referring now to FIGS. 5–7, the use of the three adapters or inserts 26, 27, and 28 is described.. The appropriate insert 26, 27, or 28 is selected, depending upon the particular type of pin 17, 18, or 19 formed upon the end of each sign post 15 being utilized. Generally, either one insert 26, 27, or 28 is inserted into the center cavity 22 of the attachment member 20 so as to facilitate a single sign post configuration or two separate inserts 26, 27, or 28 are inserted into the outboard cavities 22 to facilitate a dual sign post configuration.

Generally, the same type of post, i.e., round, threaded, or square, and complementary inserts 26, 27, and 28 are utilized for each post utilized within a particular sign holder. However, those skilled in the art will appreciate that the present invention facilitates the use of non-identical or mismatched sign posts 15. For example, a sign post 15 having a threaded pin 18 may be utilized along with another sign post 15 having a square pin 19, by selecting the appropriate complimentary adapters 27 and 28, respectively. Thus, the present invention facilitates heretofore unachievable flexibility in the configuration of such signage systems.

The inserts 26, 27, 28 preferably fit tightly into the cavities 22 so as to maintain the position of the inserts 26, 27, or 28 therein. Optionally, a looser fit may be utilized to facilitate easy and convenient interchangeability of the inserts 26, 27, and 28, as desired.

Those skilled in the art will appreciate that various non-standard signage systems are facilitated via the present invention. For example, a single sign post 15 may be installed at an outboard cavity 22 via the appropriate insert 26, 27, or 28, in an effort to provide a sign having a unique appearance or to avoid interference with a nearby obstructing structure which would not permit the use of a second sign post 15. Additionally, three separate sign posts 15 may be utilized, one in each of the three cavities 22, using the appropriate adapters 26, 27, or 28, as required to achieve a desired aesthetic effect.

It is understood that the universal merchandise signage system described herein and shown in the drawings represents only a presently preferred embodiment of the invention. Indeed, various modifications and additions may be made to such embodiment without departing from the spirit and scope of the invention. For example, those skilled in the art will appreciate that various different configurations of the uppermost end of the sign post, as well as complimentary adapters or inserts for facilitating attachment to the attachment member, are likewise suitable.

Various members of cavities for accepting such inserts and facilitating attachment to sign posts are also contemplated. These modifications and additions may be obvious to those skilled in the art and may be implemented to adapt the present invention for use in a variety of different applications.

What is claimed is:

1. A universal merchandise signage system for use with a plurality of sign posts, each sign post having a pin portion on one end of the sign post comprising one of various different configurations of the pin portions, the signage system comprising:

a sign holder;

an attachment member connected to said sign holder, which attachment member includes cavities formed therein;

at least one adapter, which is insertable in one of the cavities of the attachment member, said adapter configured to receive at least one of the various different configurations of said pin portions; and wherein said sign holder is adapted to be interchangeable among a plurality of sign posts having differently configured pin portions by utilizing said at least one adapter configured for use with desired sign posts and wherein the cavities are spaced apart in the attachment member and are separated a sufficient distance to mitigate the inadvertent insertion of a sign post into an insert within a wrong cavity.

2. The signage system of claim 1, wherein the cavities are enlarged relative to the adapter, and material in the attachment member between the enlarged cavities is sufficient for structural support of the sign holder.

* * * * *

UNITED STATES PATENT AND TRADEMARK OFFICE

CERTIFICATE OF CORRECTION

PATENT NO. : 5,906,064

DATED : May 25, 1999

INVENTOR(S) : Steven V. Field

It is certified that error appears in the above-identified patent and that said Letters Patent is hereby corrected as shown below:

Title page, "FOREIGN PATENT DOCUMENTS", first entry, change "of 1885", to read --10-1885--.

Signed and Sealed this

Ninth Day of May, 2000

*Attest:*

Q. TODD DICKINSON

*Attesting Officer*

*Director of Patents and Trademarks*